US008303323B2

(12) United States Patent
Peng et al.

(10) Patent No.: US 8,303,323 B2
(45) Date of Patent: Nov. 6, 2012

(54) PLUG STRUCTURE AND ELECTRONIC APPARATUS

(75) Inventors: Wan-Chen Peng, Taoyuan Hsien (TW); Shih-Kai Jiang, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 13/048,476

(22) Filed: Mar. 15, 2011

(65) Prior Publication Data

US 2012/0149251 A1 Jun. 14, 2012

(30) Foreign Application Priority Data

Dec. 9, 2010 (TW) ..... 99142953 A

(51) Int. Cl.
*H01R 29/00* (2006.01)

(52) U.S. Cl. ..... 439/188; 439/944

(58) Field of Classification Search ..... 439/188, 439/944; 200/51.1
See application file for complete search history.

(56) References Cited

U.S. PATENT DOCUMENTS 5,076,797 A * 12/1991 Moulton ..... 439/188

* cited by examiner

*Primary Examiner* — Phuong Dinh

(74) *Attorney, Agent, or Firm* — Muncy, Geissler, Olds & Lowe, PLLC

(57) ABSTRACT

A plug structure is cooperated with a jack and includes an insulating body, a signal electrode, an elastic-conductive component, a first electrode and a second electrode. The signal electrode is disposed around the inner periphery of the insulating body. The elastic-conductive component is disposed at the signal electrode and electrically connected with the signal electrode. The first electrode is disposed in the insulating body and initially contacts with the elastic-conductive component. When the plug structure is connected with the jack, the elastic-conductive component is separated with the first electrode. The second electrode is disposed around the outer periphery of the insulating body. An electronic apparatus with the plug structure is also disclosed. The plug structure is capable of controlling the operation of the electronic apparatus, thereby reducing the cost for the control circuit.

9 Claims, 4 Drawing Sheets

PLUG STRUCTURE AND ELECTRONIC APPARATUS

CROSS REFERENCE TO RELATED APPLICATIONS

This Non-provisional application claims priority under 35 U.S.C. §119(a) on Patent Application No(s). 099142953 filed in Taiwan, Republic of China on Dec. 9, 2010, the entire contents of which are hereby incorporated by reference.

BACKGROUND OF THE INVENTION

1. Field of Invention

The present invention relates to a plug structure and an electronic apparatus, and in particular, to a plug structure and an electronic apparatus that have a signal electrode.

2. Related Art

The plug and jack are usually configured for transmitting power signals and/or voice signals between two systems. Due to the development of electronic apparatuses, such as audio-visual appliances, computers, MP3, mobile phones, PDA, GPS or power supply products, various kinds of plugs and jacks are configured in theses electronic apparatuses.

As shown in FIG. 1, a conventional plug structure 1 includes an insulating body 11, a signal electrode 12, a positive electrode 13 and a negative electrode 14. The negative electrode 14 is disposed around the outer periphery of the insulating body 11, and the signal electrode 12 and the positive electrode 13 are disposed on the insulating body 11. The insulating body 11 can electrically isolate the negative electrode 14, the positive electrode 13 and the signal electrode 12. By connecting the plug structure 1 with the corresponding jack, the electronic apparatus with the plug structure 1 can transmit and receive power and signals with other apparatus with the jack.

However, the conventional plug structure 1 can only provide the basic power and signal transmission function, but it can not provide the control function to control the operation of the electronic apparatus.

Therefore, it is an important subject to provide a plug structure and an electronic apparatus that can control the operation of the electronic apparatus through the plug structure, thereby reducing the cost for the control circuit.

SUMMARY OF THE INVENTION

In view of the foregoing subject, an objective of the present invention is to provide a plug structure and an electronic apparatus that can control the operation of the electronic apparatus through the plug structure, thereby reducing the cost for the control circuit.

To achieve the above objective, the present invention discloses a plug structure cooperated with a jack. The plug structure includes an insulating body, a signal electrode, an elastic-conductive component, a first electrode and a second electrode. The signal electrode is disposed around the inner periphery of the insulating body. The elastic-conductive component is disposed at the signal electrode and electrically connected with the signal electrode. The first electrode is disposed in the insulating body and initially contacts with the elastic-conductive component. When the plug structure is connected with the jack, the elastic-conductive component is separated with the first electrode. The second electrode is disposed around the outer periphery of the insulating body.

In one embodiment of the invention, the first electrode and the second electrode can be a positive electrode and a negative electrode, respectively; otherwise, they can be a negative electrode and a positive electrode, respectively. The elastic-conductive component contacts with the bottom of the first electrode. The signal electrode and the elastic-conductive component can be integrally formed as one piece; otherwise, they can be connected by welding, embedding, engaging, locking, or adhering.

In addition, when the plug structure and the jack are separated, the first electrode is electrically connected with the signal electrode through the elastic-conductive component. When the plug structure and the jack are connected, an end portion of the jack contacts against the elastic-conductive component so as to apart the signal electrode from the first electrode.

To achieve the above objective, the present invention also discloses an electronic apparatus including a housing, a control unit, and a plug structure. The control unit is disposed in the housing. The plug structure is cooperated with a jack and electrically connected with the control unit. In one embodiment, the electronic apparatus can be a power supply product.

In the present invention, the plug structure includes an insulating body, a signal electrode, an elastic-conductive component, a first electrode and a second electrode. The signal electrode is disposed around the inner periphery of the insulating body. The elastic-conductive component is disposed at the signal electrode and electrically connected with the signal electrode. The first electrode is disposed in the insulating body and initially contacts with the elastic-conductive component. When the plug structure is connected with the jack, the elastic-conductive component is separated with the first electrode. The second electrode is disposed around the outer periphery of the insulating body.

In one embodiment of the invention, the first electrode and the second electrode can be a positive electrode and a negative electrode, respectively; otherwise, they can be a negative electrode and a positive electrode, respectively. The elastic-conductive component contacts with the bottom of the first electrode. The signal electrode and the elastic-conductive component can be integrally formed as one piece; otherwise, they can be connected by welding, embedding, engaging, locking, or adhering.

In addition, when the plug structure and the jack are separated, the first electrode is electrically connected with the signal electrode through the elastic-conductive component. When the plug structure and the jack are connected, an end portion of the jack contacts against the elastic-conductive component so as to apart the signal electrode from the first electrode.

As mentioned above, the plug structure of the present invention includes a first electrode for contacting with the elastic-conductive component. When the plug structure is connected to the jack, the elastic-conductive component is separated from the first electrode so as to apart the signal electrode from the first electrode. Accordingly, when the plug structure of the present invention is configured in the electronic apparatus, the electronic apparatus can transmit and receive power and signals with other apparatuses by connecting the plug structure and the jack. In addition, when the plug structure and the jack are separated, the elastic-conductive electrode can provide an elastic force to push the signal electrode to electrically connecting with the first electrode. At the same time, the signal with respect to this connection can be transmitted to the control unit of the electronic apparatus to enable the electronic apparatus to operate a power-saving mode or other modes. Consequently, the plug structure of the present invention can be used to control the operation of the electronic apparatus without configuring the additional switching element. This can also reduce the cost for the control circuit.

BRIEF DESCRIPTION OF THE DRAWINGS

The present invention will become more fully understood from the subsequent detailed description and accompanying drawings, which are given by way of illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
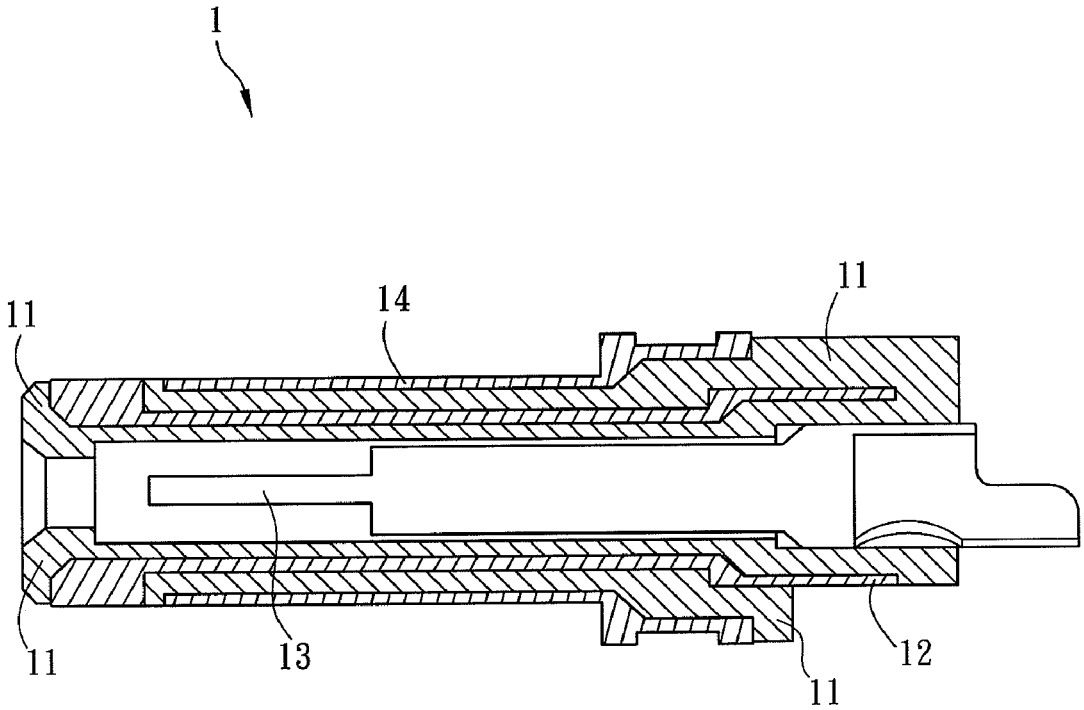
FIG. 1(Prior Art)
FIG. 1 is a schematic diagram showing a conventional plug structure.
Figure 2A:
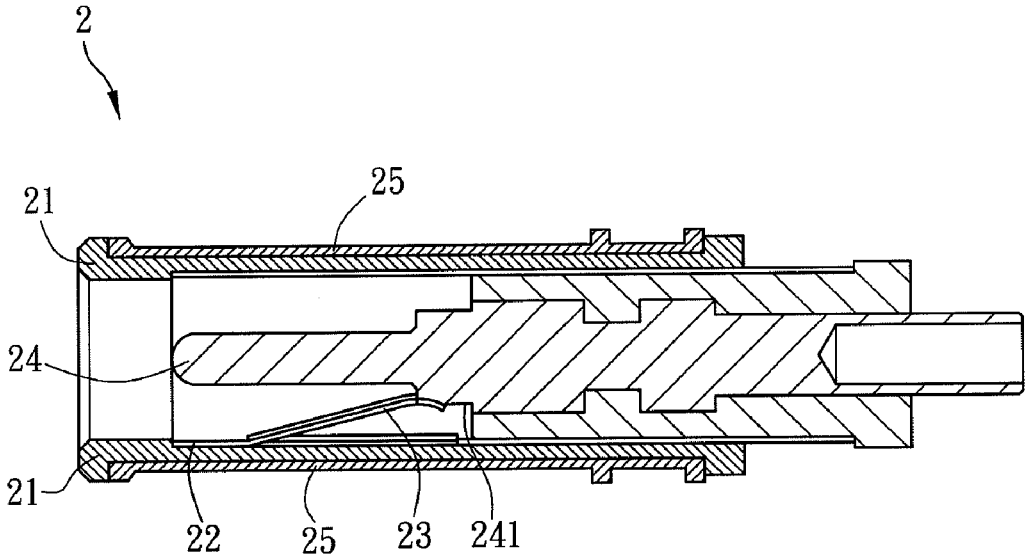
FIG. 2A and FIG. 2B are a cross-sectional view and a perspective sectional view of a plug structure according to an embodiment of the present invention.
Figure 2B:
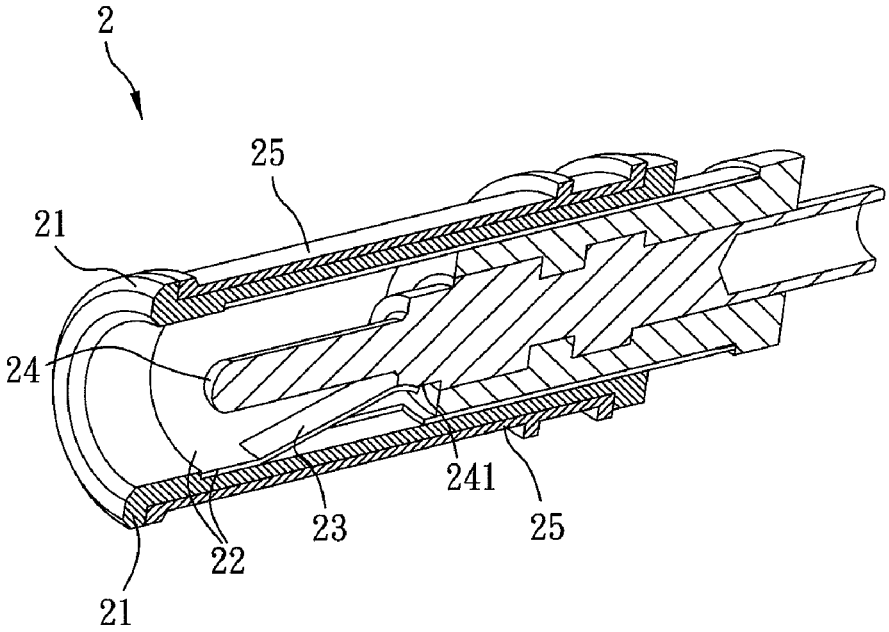
Figure 3:
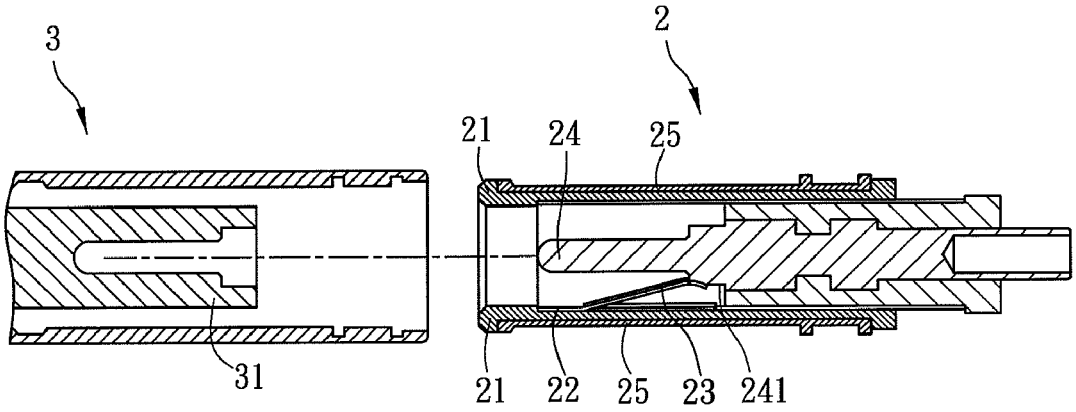
FIG. 3 is a schematic diagram showing the connection between the plug structure of the present invention and a jack.

FIG. 2A and FIG. 2B are a cross-sectional view and a perspective sectional view of a plug structure 2 according to an embodiment of the present invention, and FIG. 3 is a schematic diagram showing the connection between the plug structure 2 and a jack 3. Referring to FIGS. 2A to 3, the plug structure 2 is cooperated with the jack 3 and includes an insulating body 21, a signal electrode 22, an elastic-conductive component 23, a first electrode 24 and a second electrode 25. The plug structure 2 is, for example but not limited to, an audio-visual appliance, a computer, an MP3, a mobile phone, a PDA, a GPS or a power supply product.

The signal electrode 22 is disposed around the inner periphery of the insulating body 21, and the second electrode 25 is disposed around the outer periphery of the insulating body 21. In other words, the insulating body 21 can electrically isolate the signal electrode 22 and the second electrode 25.

The elastic-conductive component 23 is disposed at the signal electrode 22 and electrically connected with the signal electrode 22. The elastic-conductive component 23 of the present invention can be an elastic sheet, a spring, or a clip, and in this embodiment, the elastic-conductive component 23 is an elastic sheet for example. In the present invention, the signal electrode 22 and the elastic-conductive component 23 can be integrally formed as one piece, or they can be connected, for example, by welding, embedding, engaging, locking, or adhering. In this embodiment, the signal electrode 22 and the elastic-conductive component 23 is integrally formed as one piece. That is, a portion of the signal electrode 22 functions as the elastic-conductive component 23.

The first electrode 24 is disposed in the insulating body 21 and initially contacts with the elastic-conductive component 23. The first electrode 24 and the second electrode 25 can be a positive electrode and a negative electrode, respectively; otherwise, they can be a negative electrode and a positive electrode, respectively. In general configuration, the first electrode 24 is a positive (power) electrode and the second electrode 25 is a negative (ground) electrode.

In this embodiment, the elastic-conductive component 23 contacts with the bottom 241 of the first electrode 24. Of course, the elastic-conductive component 23 may contact with other portions of the first electrode 24.

In addition, when the plug structure 2 and the jack 3 are separated, the elastic force provided by the elastic-conductive component 23 can push the signal electrode 22 to electrically connecting with the first electrode 24. Moreover, when the plug structure 2 and the jack 3 are connected, the elastic-conductive component 23 is separated from the first electrode 24. In this embodiment, when the plug structure 2 and the jack 3 are connected, one end portion 31 of the jack 3 can contact against the elastic-conductive component 23 so as to apart the signal electrode 22 from the first electrode 24. In other words, when the plug structure 2 is connected with the jack 3, the first electrode 24 is electrically separated from the signal electrode 22; otherwise, when the plug structure 2 is separated from the jack 3, the first electrode 24 is electrically connected with the signal electrode 22.

Figure 4:
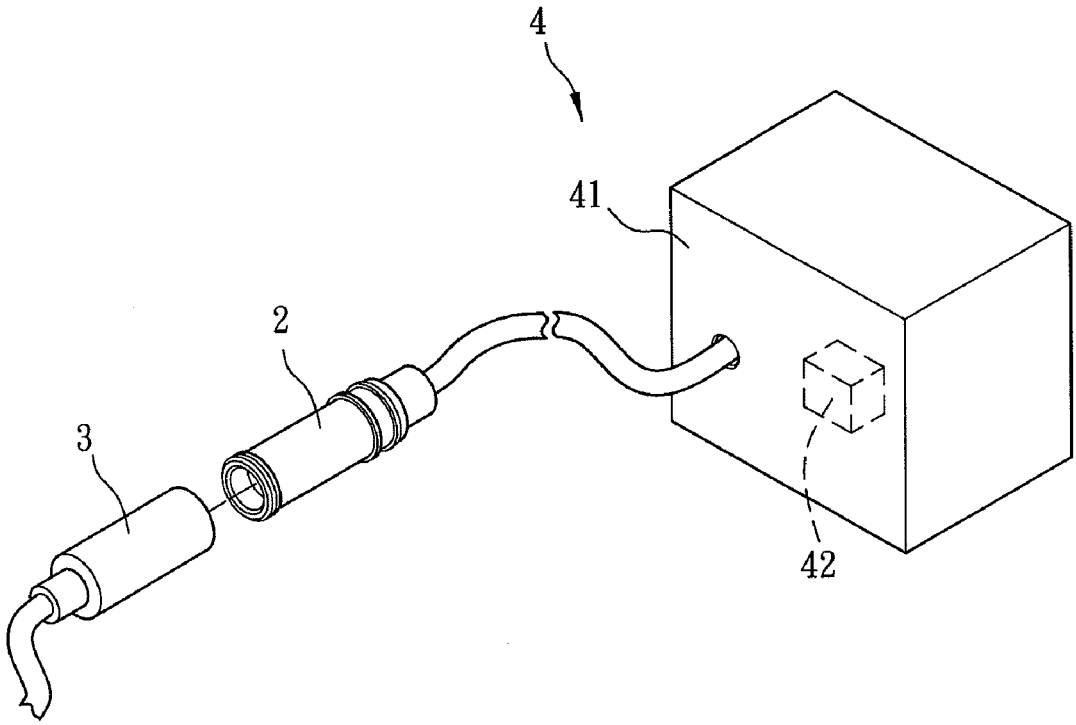
FIG. 4 is a schematic diagram showing the application of the plug structure of the present invention with an electronic apparatus.

FIG. 4 is a schematic diagram showing the application of the plug structure 2 of the present invention with an electronic apparatus 4.

With reference to FIG. 4 in view of FIG. 3, the electronic apparatus 4 includes a housing 41, a control unit 42, and a plug structure 2. The electronic apparatus 4 can be an audio-visual appliance, a computer, an MP3, a mobile phone, a PDA, a GPS or a power supply product.

The control unit 42 is disposed in the housing 41. The plug structure 2 is cooperated with a jack 3 and electrically connected with the control unit 42. In this embodiment, the electronic apparatus 4 can transmit and receive power and signals with external (other) apparatuses through the connection of the plug structure 2 and the jack 3.

Since the applications of the plug structure 2 and the jack 3 are illustrated in the above embodiment, the detailed description thereof will be omitted here.

Accordingly, if the plug structure 2 is configured in the electronic apparatus 4, the elastic-conductive component 23 is separated from the first electrode 24 when the plug structure 2 is connected to the jack 3, so that the signal electrode 22 can be separated from the first electrode 24. Accordingly, the electronic apparatus 4 can transmit and receive power and signals with other apparatuses by connecting the plug structure 2 and the jack 3. In this case, the electronic apparatus 4 can operate in a normal mode. In addition, when the plug structure 2 and the jack 3 are separated, the elastic-conductive electrode 23 can provide an elastic force to push the signal electrode 22 to electrically connecting with the first electrode 24. At the same time, the signal with respect to this connection can be transmitted to the control unit 42 of the electronic apparatus 4 to enable the electronic apparatus 4 to operate a power-saving mode or other modes. Consequently, the operation of the electronic apparatus 4 can be controlled without configuring the additional switching element, and this can also reduce the cost for the control circuit.

In summary, the plug structure of the present invention includes a first electrode for contacting with the elastic-conductive component. When the plug structure is connected to the jack, the elastic-conductive component is separated from the first electrode so as to apart the signal electrode from the first electrode. Accordingly, when the plug structure of the present invention is configured in the electronic apparatus, the electronic apparatus can transmit and receive power and signals with other apparatuses by connecting the plug structure and the jack. In addition, when the plug structure and the jack are separated, the elastic-conductive electrode can provide an elastic force to push the signal electrode to electrically connecting with the first electrode. At the same time, the signal with respect to this connection can be transmitted to the control unit of the electronic apparatus to enable the electronic apparatus to operate a power-saving mode or other modes. Consequently, the plug structure of the present invention can be used to control the operation of the electronic apparatus without configuring the additional switching element. This can also reduce the cost for the control circuit.

Although the present invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the present invention.

What is claimed is:

1. An electronic apparatus, comprising:

a housing;

a control unit disposed in the housing; and a plug structure cooperated with a jack and electrically connected with the control unit, the plug structure comprising:

an insulating body, a signal electrode disposed around an inner periphery of the insulating body, an elastic-conductive component disposed at the signal electrode and electrically connected with the signal electrode, a first electrode disposed in the insulating body and initially contacting with the elastic-conductive component, wherein when the plug structure is connected with the jack, the elastic-conductive component is separated with the first electrode so as to apart the signal electrode from the first electrode, and a second electrode disposed around an outer periphery of the insulating body, wherein a signal is transmitted to the control unit to enable the electronic apparatus to operate a power-saving mode while the plug structure and the jack are separated.

2. The electronic apparatus according to claim 1, wherein the first electrode and the second electrode are respectively a positive electrode and a negative electrode, or the first electrode and the second electrode are respectively a negative electrode and a positive electrode.

3. The electronic apparatus according to claim 1, wherein the elastic-conductive component contacts with the bottom of the first electrode.

4. The electronic apparatus according to claim 1, wherein the elastic-conductive component comprises an elastic sheet, a spring, or a clip.

5. The electronic apparatus according to claim 1, wherein the signal electrode and the elastic-conductive component are integrally formed as one piece.

6. The electronic apparatus according to claim 1, wherein the signal electrode and the elastic-conductive component are connected by welding, embedding, engaging, locking, or adhering.

7. The electronic apparatus according to claim 1, wherein when the plug structure and the jack are separated, the first electrode is electrically connected with the signal electrode through the elastic-conductive component.

8. The electronic apparatus according to claim 1, wherein when the plug structure and the jack are connected, an end portion of the jack contacts against the elastic-conductive component so as to apart the signal electrode from the first electrode.

9. The electronic apparatus according to claim 1, wherein the electronic apparatus is a power supply product.

* * * * *